United States Patent [19]

Pavone

[11] 4,323,149

[45] Apr. 6, 1982

[54] TRANSFER APPARATUS FOR NATURAL TOBACCO LEAVES

[75] Inventor: Robert J. Pavone, South Windsor, Conn.

[73] Assignee: Gulf & Western Corporation, New York, N.Y.

[21] Appl. No.: 129,894

[22] Filed: Mar. 13, 1980

[51] Int. Cl.[3] ..... B65G 37/00; B65G 17/46; B65H 9/08

[52] U.S. Cl. ..... 198/471; 198/689; 271/180

[58] Field of Search ..... 198/689, 465, 471, 597; 271/180, 184–186; 414/73, 72, 752

[56] References Cited

U.S. PATENT DOCUMENTS

| | | | |
|---|---|---|---|
| 2,960,898 | 11/1960 | Wheeler . | |
| 3,152,497 | 10/1964 | Godfrey . | |
| 3,395,915 | 8/1968 | Clausen | 414/73 |
| 3,406,966 | 10/1968 | Walton | 271/180 |
| 3,515,149 | 6/1970 | Meyer . | |
| 3,542,030 | 11/1970 | Hooper . | |
| 3,542,038 | 11/1970 | Hooper . | |
| 3,591,044 | 7/1971 | Hooper . | |
| 3,592,334 | 7/1971 | Fleischauer | 198/689 |
| 4,222,396 | 5/1978 | Anderson | 131/105 |

FOREIGN PATENT DOCUMENTS

| | | |
|---|---|---|
| 872617 | 6/1979 | Belgium . |
| 7714544 | 6/1979 | Belgium . |
| 7712589 | 5/1979 | Netherlands . |

*Primary Examiner*—Robert B. Reeves
*Assistant Examiner*—Brian Bond
*Attorney, Agent, or Firm*—Meyer, Tilberry & Body

[57] ABSTRACT

An apparatus for transferring a natural tobacco leaf from a continuous, flexible conveyor belt to a generally flat leaf receiving member at a preselected position in the normal path of travel of the belt. The apparatus includes a plenum box having a pressure opening defined by a peripheral edge of the box, an arrangement for forcing the belt and box from the normal path position toward the receiving member at the preselected position and a mechanism for creating a positive pressure adjacent one surface of the belt to force the leaf from the belt onto the receiving member.

17 Claims, 10 Drawing Figures

AIR ON
TRANSFER
L1
L2

TRANSFER APPARATUS FOR NATURAL TOBACCO LEAVES

Related applications are copending application Ser. No. 884,849 filed Mar. 9, 1978, and application Ser. No. 041,873 filed May 23, 1979. These applications are incorporated by reference herein.

The present invention relates to the art of transferring natural tobacco leaves and more particularly to an apparatus for transferring a leaf from a moving belt onto a leaf receiving member in the form of a cutting table.

BACKGROUND OF INVENTION

The present invention relates to a transfer apparatus for transferring a natural tobacco leaf onto a leaf receiving member, such as a cutting table for cutting cigar wrappers from the leaf, and it will be described with particular reference thereto; however, it is appreciated that the invention has broader applications and may be used in other tobacco handling equipment.

As is well known in the cigar manufacturing art, wrappers are cut from synthetic material or natural tobacco leaves and then wrapped around a cigar filler to produce the desired outer appearance for a cigar. In recent years, a substantial amount of effort has been devoted to automating the production of cigars. In this effort, it has been suggested to develop an integrated machine which will accept natural tobacco leaves, either whole or cut in half, and automatically process these leaves to cut wrappers therefrom. These machines require rapid processing of the natural tobacco leaves in a positive manner so that uniform end results are obtained at a rapid speed necessary for economic justification of the cost involved in the automatic equipment. The present invention has been developed in a program for the overall development of a machine which will spread a natural tobacco leaf onto a perforated continuous conveyor belt, scan the leaf to locate the position from which a wrapper can be cut and then perform the cutting operation to produce the wrapper. In this type of program, it was necessary to develop an apparatus for transferring the natural tobacco leaf from the continuous, flexible conveyor belt to a generally flat receiving member in the form of a cutting table at a preselected position in the normal path of movement of the continuous belt. Normal leaf handling transfer devices, such as pick-up plates and transfer rolls presented substantial disadvantages. These devices would require an intermediate transfer element for transferring the leaf from the belt to a cutting table. Also, two separate control arrangements would be required for releasing the leaf from the belt and then capturing the leaf on an intermediate transfer unit. The complexity of these arrangements negated the ability to provide positive, rapid transfer of the natural tobacco leaf within a relatively confined space. Also, they would involve frequent adjustment to assure uniform registering or orientation of the tobacco leaf with respect to subsequent processing equipment.

THE INVENTION

The present invention relates to a transfer apparatus which overcomes the disadvantages mentioned above and results in a positive transfer of a natural tobacco leaf from a moving continuous belt to a generally flat leaf receiving member, such as a cutting table used in an automatic wrapper cutting device for production of cigars.

In accordance with the present invention, there is provided a novel apparatus for transferring a natural tobacco leaf from a continuous, flexible conveyor belt to a generally flat leaf receiving member at a preselected position in the normal path of travel of the belt. This belt has a known width, a first surface facing away from the receiving member at the preselected position, a second surface facing toward and generally parallel to the receiving member at the preselected position and a plurality of apertures forming pressure equalizing passages between the first and second surfaces. In accordance with the invention, the apparatus comprises a plenum box having a pressure opening defined by a peripheral edge of the box, with the edge lying generally in a plane parallel to the first surface at the preselected position; means for creating a vacuum in the box and communicated with the pressure opening; means for forcing the belt at the preselected position from the normal path in a direction toward the receiving member and into a transfer position with a leaf on the second surface lying against the receiving member; and, means for creating a positive pressure adjacent the first surface and at the preselected position only when the second surface and a leaf thereon are forced against the receiving member. In this manner, by forcing the plenum box downward toward the belt, the belt is deflected to bring the leaf carried on the belt into contact with the receiving member. At that time, positive pressure releases the leaf from the belt and allows it to be captured by a vacuum surface on the receiving member. Consequently, a relatively simple reciprocal movement can perform the necessary function of transferring a natural tobacco leaf from a continuous, flexible conveyor belt onto a flat receiving member which, in the preferred embodiment of the invention is a cutting table for subsequent cutting of a wrapper from the leaf deposited on the receiving member during the transfer operation.

In accordance with another aspect of the invention, there is provided an arrangement for sensing when the belt is in the transfer position so that the plenum box can be vented at this instance. In accordance with another aspect of the invention, this venting operation is used to release the belt from its transfer, deflected position. Thus, by merely initiating a transfer operation the transfer can take place and the belt can assume its natural position without sequentially created commands or signals to the transfer apparatus.

In accordance with another aspect of the present invention, the belt is forced into the transfer position by two parallel abutting members which push downwardly on the belt to shift the belt into a leaf transfer position. The abutting members carry the plenum box so that the box remains in contact with the conveyor belt as it is being deflected into the transfer position. This allows the pressure within the plenum box to control the actual transfer operation after the belt has been deflected into the transfer position.

The primary object of the present invention is the provision of an apparatus for transferring a natural tobacco leaf from a continuous, flexible belt to a generally flat leaf receiving surface, such as the vacuum holding surface of a cutting table, which apparatus can operate at a rapid rate to allow over approximately thirty (30) successive transfers per second.

Still a further object of the present invention is the provision of an apparatus as defined above, which apparatus provides direct transfer without intermediate transferring mechanisms between the belt and the receiving surface which actually forms a processing unit.

Still a further object of the present invention is the provision of an apparatus as defined above, which apparatus requires a single signal or command to perform the transfer operation.

Another object of the present invention is the provision of an apparatus as defined above, which apparatus requires a limited number of components that are relatively inexpensive and require a limited amount of space.

These and other objects and advantages will become apparent from the following description in which the accompanying drawings are as set forth in the next section.

BRIEF DESCRIPTION OF THE DRAWINGS

In this application, the following drawings are employed.

DISCLOSURE

Figure 1:
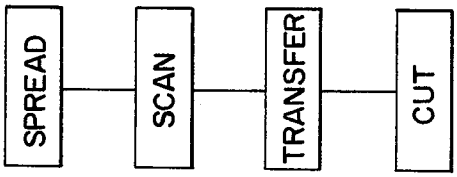
FIG. 1 is a schematic flow chart illustrating certain operating characteristics of a machine employing the present invention.

Referring now to the drawings, wherein the showings are for the purpose of illustrating the invention only and not for the purpose of limiting same, FIG. 1 shows in block form certain process steps which are used in automatically cutting a cigar wrapper from a natural tobacco leaf by a machine employing the novel transfer arrangement of the present invention. In accordance with these steps, a leaf is first spread onto a belt where it is then scanned to locate surface imperfections and determine the outline of the leaf. This scanning operation creates digital signals which are stored in a memory unit of a digital computer for calculating the desired position at which wrappers can be cut from a particular leaf represented by the digital information stored in the memory of the computer. Thereafter, the leaf is transferred in an oriented fashion onto a cutting device which performs the cutting operation determined by the computations of the digital computer. The present invention relates only to the transfer operation of the total machine; however, the total machine is shown in FIGS. 2-3 as background information for understanding the environment to which the present invention is directed.

Figure 2:
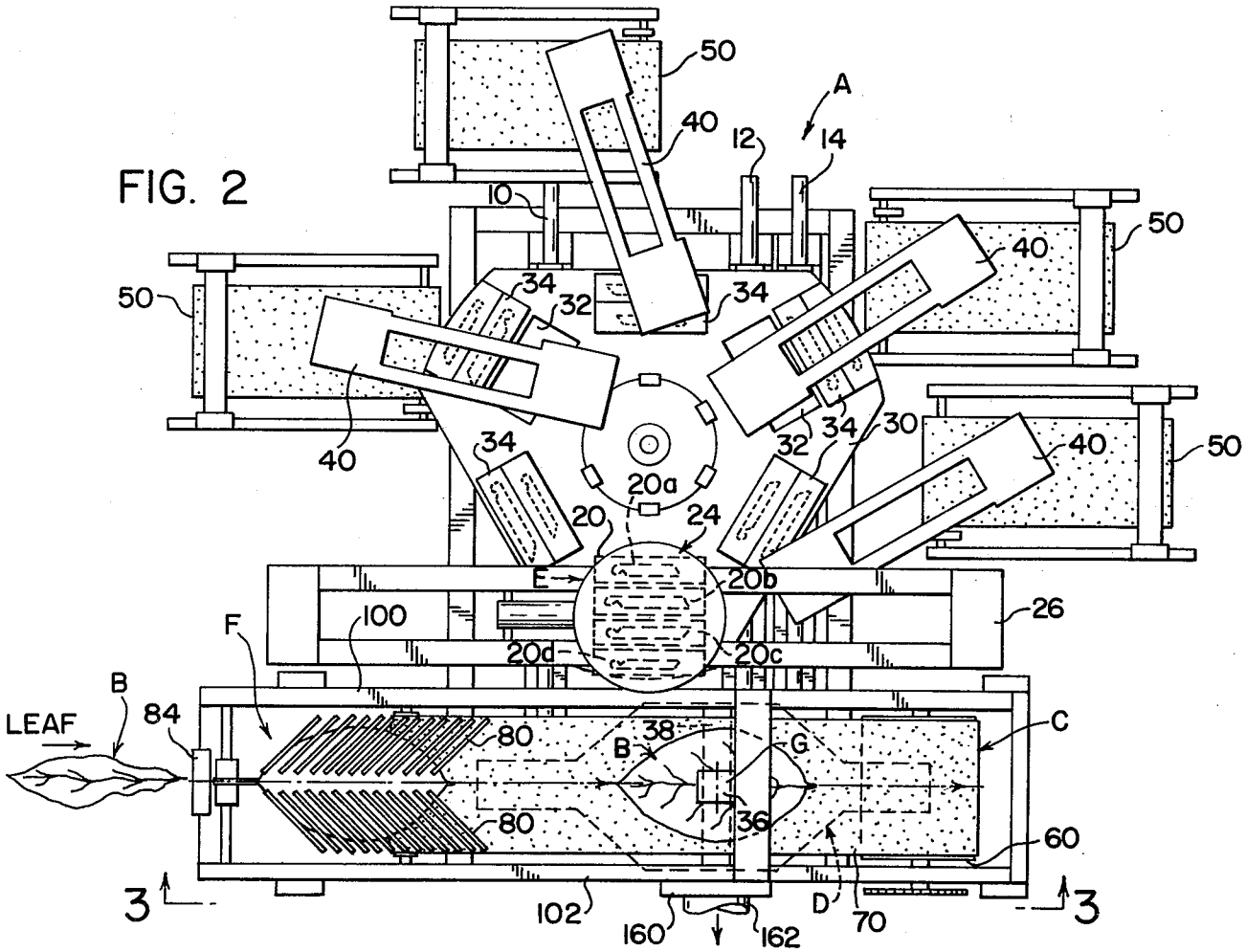
FIG. 2 is a top plan view of a wrapper cutting machine of the type which employs the present invention and for which the present invention was developed.
Figure 3:
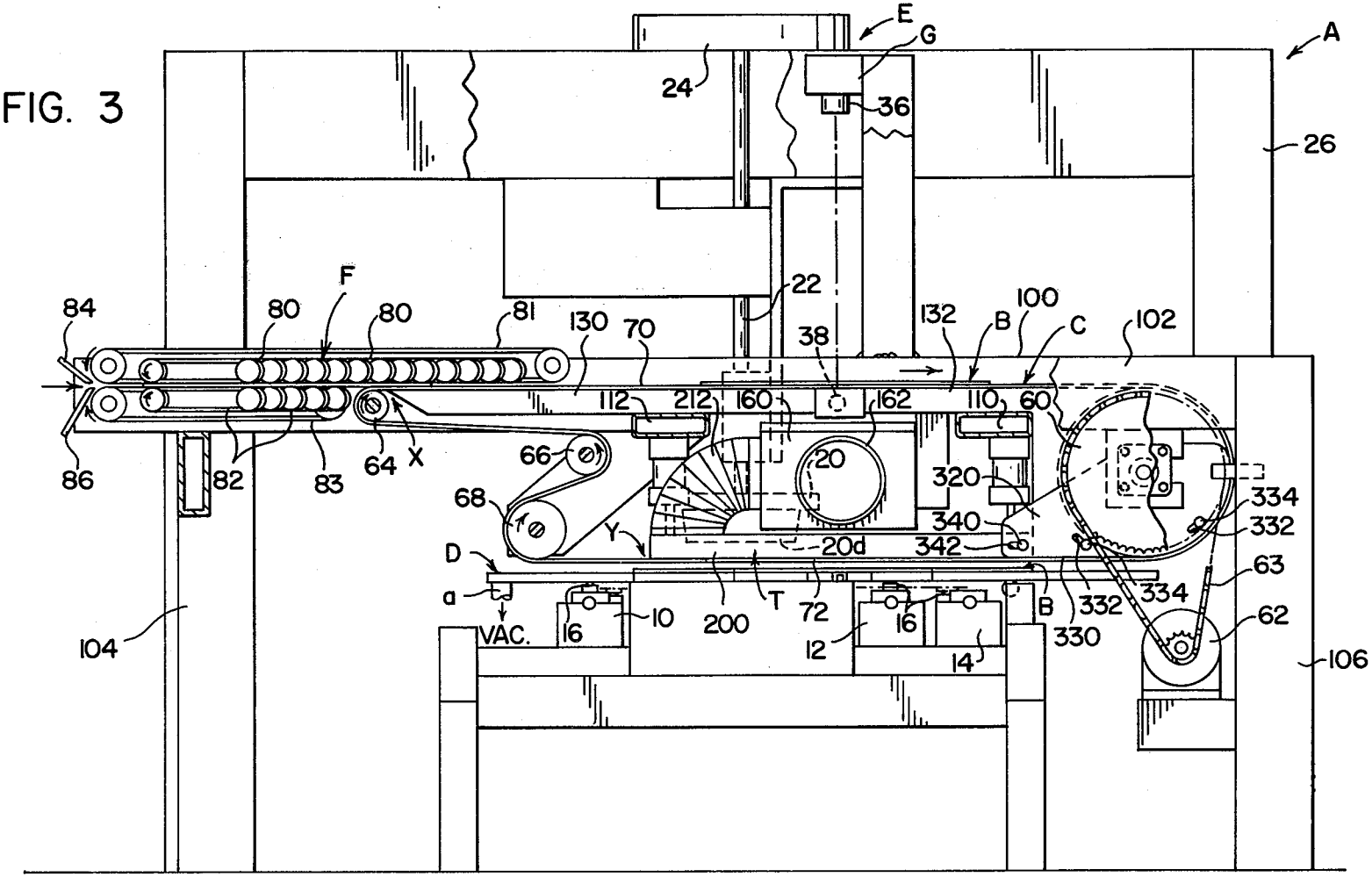
FIG. 3 is a front view taken generally along line 3—3 of FIG. 2.
Figures 5, 10:
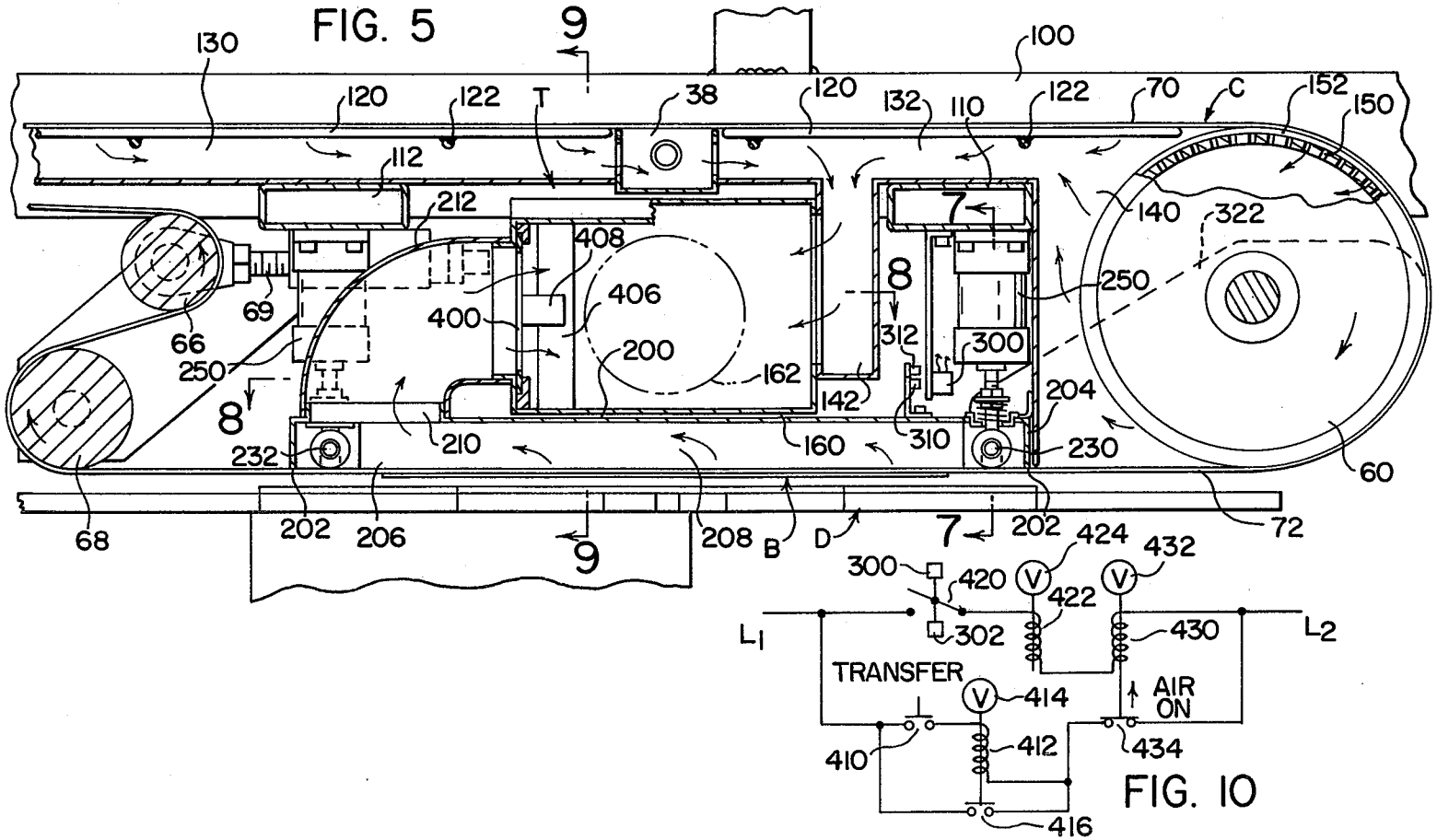
FIG. 5 is a cross-sectional view showing the preferred embodiment of the present invention as adopted for the machine illustrated in FIGS. 2 and 3.
Figure 7:
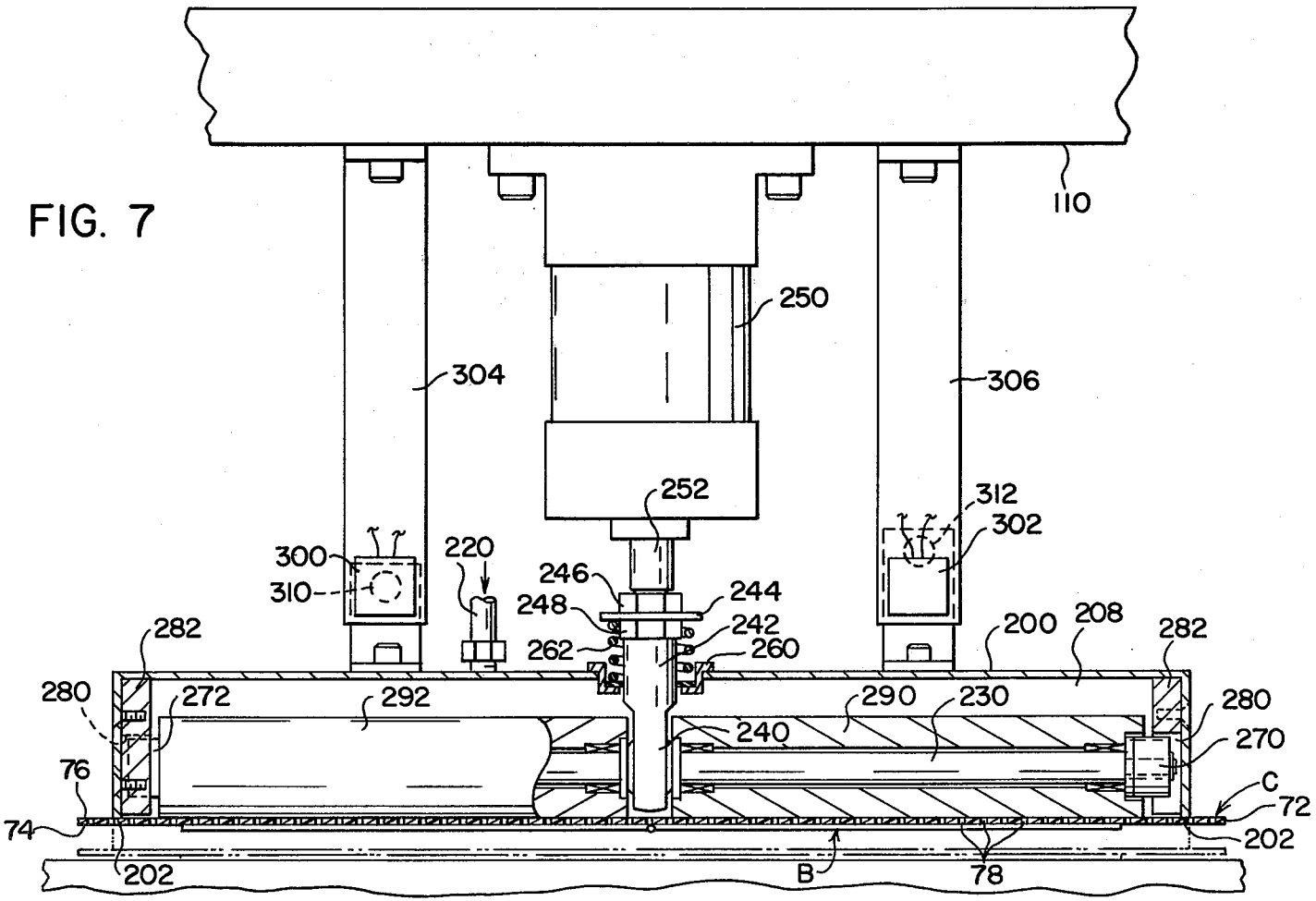
FIG. 7 is an enlarged, partial cross-sectional view taken generally along line 7—7 of FIG. 5.

Referring now specifically to FIGS. 2 and 3, machine A is used for cutting cigar wrappers from natural tobacco leaves B and employs a continuous, flexible, perforated conveyor belt C onto which the tobacco leaves are spread in spaced relationship. The belt moves along a preselected normal path shown in FIG. 3 and extends above a movable cutting table D, which employs an upper flat surface over which is created a vacuum by an appropriate means including a vacuum inlet a, best shown in FIG. 3. This upper surface of table D is flat and is used to capture a leaf which is deposited thereon during operation of the novel transfer device constructed in accordance with the present invention. Consequently, the upper cutting surface of table D forms the leaf receiving member or surface for the transfer action of a natural tobacco leaf B from belt C to the movable table D. After receiving a tobacco leaf from the preselected lower position shown in FIG. 3, table D is moved by a plurality of linear elements 10, 12, 14 which are actuatable to maneuver the table D from below belt C into an oriented cutting position at a cutting station E. By appropriate positioning of the linear elements 10, 12, 14, table D which is connected to the linear elements by upwardly extending connectors 16, is moved into the desired orientation with respect to the cutting station. A reciprocally mounted cutting head or cutter 20 is provided with a plurality of independent cutters **20*a*-20*d* which can be selected to cut a wrapper from the leaf by moving the cutter against the leaf held on table D. This cutting action can be accomplished by a variety of mechanisms; however, in the illustrated embodiment, a reciprocally mounted rod 22 is driven by an upper cylinder 24 which can be more elongated than schematically illustrated in FIG. 3. Cylinder 24 is secured onto appropriate frame 26 so that operation of the cylinder will drive the cutting head 20 against the table D for performing a cutting operation at the cutting station E. An indexable transfer table 30 described in detail in prior application Ser. No. 41,873, filed May 23, 1979, is used to receive a cut wrapper after it has been cut from a natural tobacco leaf. To allow a cutting action, table 30 includes clearance openings 32 and chordal cut sections from the table. A plurality of wrapper nests 34 receive cut wrappers from cutters 20*a*-20*d*. In accordance with this concept, a cut is made by a cutter when an access portion of table 30 is aligned with the cutter being used for cutting. Thereafter, the wrapper is captured in the cutter, which is a clicker die type, for subsequent depositing on a wrapper nest 34 indexed to the cutting station E. Thus, a cut wrapper is deposited onto a nest after the table 30 has been indexed. This action continues with a deposit being made at the same time a cut is being made at the cutting station. Consequently, cigar wrappers are deposited on the several wrapper nests 34 on table 30 for subsequent use in wrapping around cigars. To store these wrappers, there are provided movable pick-up units, schematically illustrated as units 40. Each of these units pick up a wrapper from a particular nest 34 and deposit the wrapper onto appropriate storage device 50, which storage devices are schematically illustrated as bobbin winders of the general type often used in storing wrappers for subsequent wrapping around cigars. As illustrated in FIGS. 1 and 2, machine A includes an introductory leaf spreader F which spreads the leaf onto belt C where it is captured by a vacuum created through the belt in a manner to be described later. As the belt is moved between two indexed positions, it passes through the scanning area of a scanning device G, which includes a sensor head 36 and a transversely extending light source 38 mounted below the belt, as shown in FIG. 3. This illuminates the natural tobacco leaf through the belt C which is transparent or translucent. This is a general description of the environment to which the present invention is directed. Essentially, the invention relates to an apparatus for transferring a leaf B from belt C, at a preselected position which, in the illustrated embodiment, is directly above table D as shown in FIG. 3. The transparent or translucent, perforated, continuous belt C is driven in a normal path, shown in FIG. 3 and defined by several rolls or rollers. A driven vacuum surface roll 60 is intermittently driven by an indexing motor 62 through a chain 63. Guide rolls 64, 66 and 68 control the normal path of belt C. A take-up mechanism 69 for roll 66, as shown in FIG. 5, is used to place the belt under tension in a manner to define a straight upper run 70 and a straight lower run 72. Belt C, as best shown in FIG. 7, includes a first outer surface 74, a second inner surface 76 and a multitude of apertures 78 used to generally equalize the pressure adjacent surfaces 74, 76. Of course, apertures 78 present substantial loss of vacuum through the belt in areas where the belt is not covered by a leaf. Spreader F may take a variety of forms; however, in the illustrated embodiment, upper spreading belt 80 driven by belt 81 contacts the upper surface of the leaf to spread the leaf preparatory to depositing the leaf onto surface 74 of belt C. Lower, coacting spreading belts 82 engage the lower portion of the leaf for coacting with the upper belt 80 to perform the total spreading operation before the spreader deposits the leaf onto belt C. As can be seen, during movement of belt C between indexing, the leaf is placed onto the belt and the leaf is scanned by scanning device G to provide the cutting information which is subsequently used for locating the cutting positions. Thereafter, the leaf is indexed to the preselected lower position shown in FIG. 3** where the spread, scanned leaf is deposited onto table D.

Figure 4:
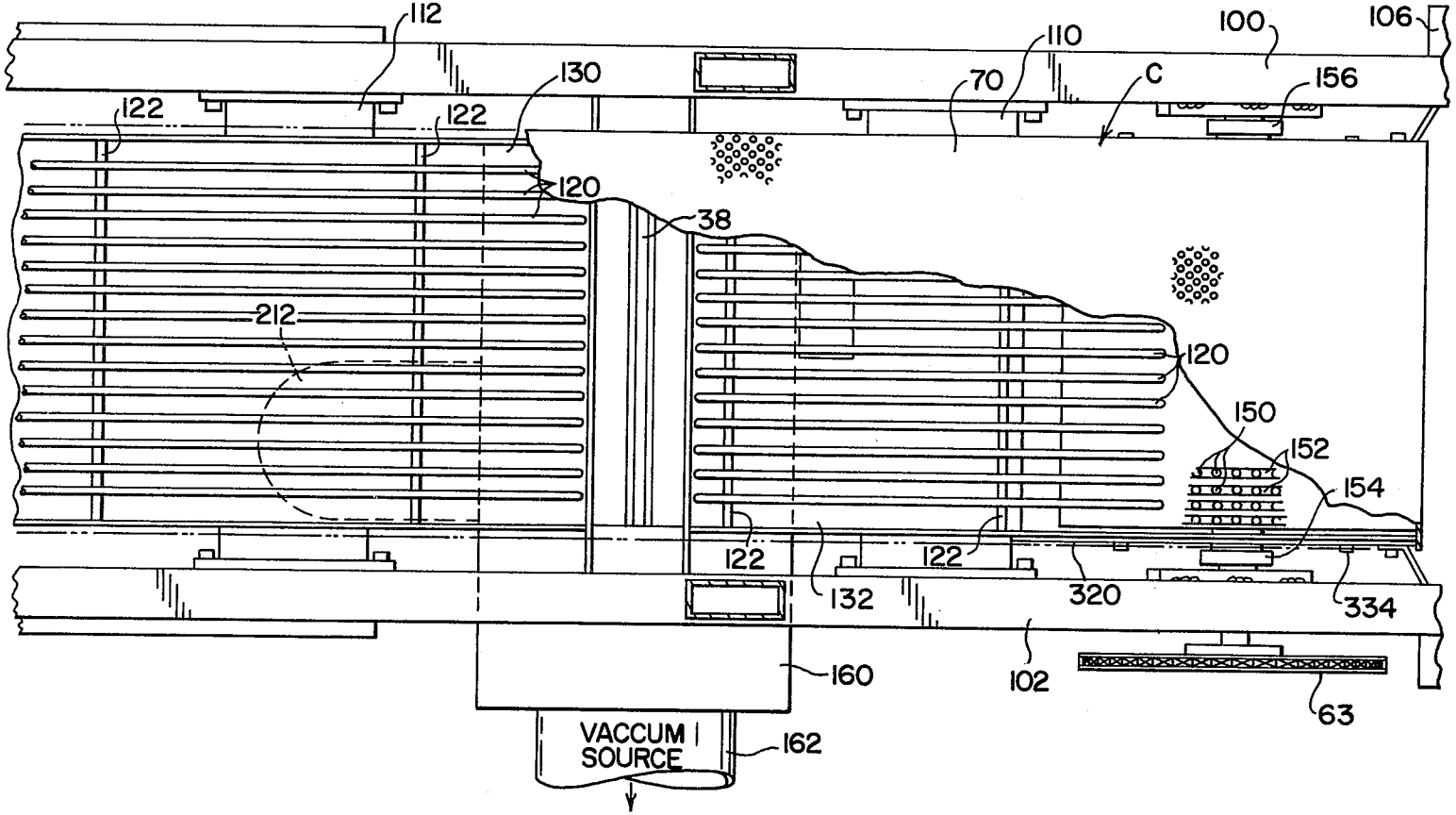
FIG. 4 is an enlarged, top view showing part of the apparatus as illustrated in FIGS. 2 and 3.
Figure 6:
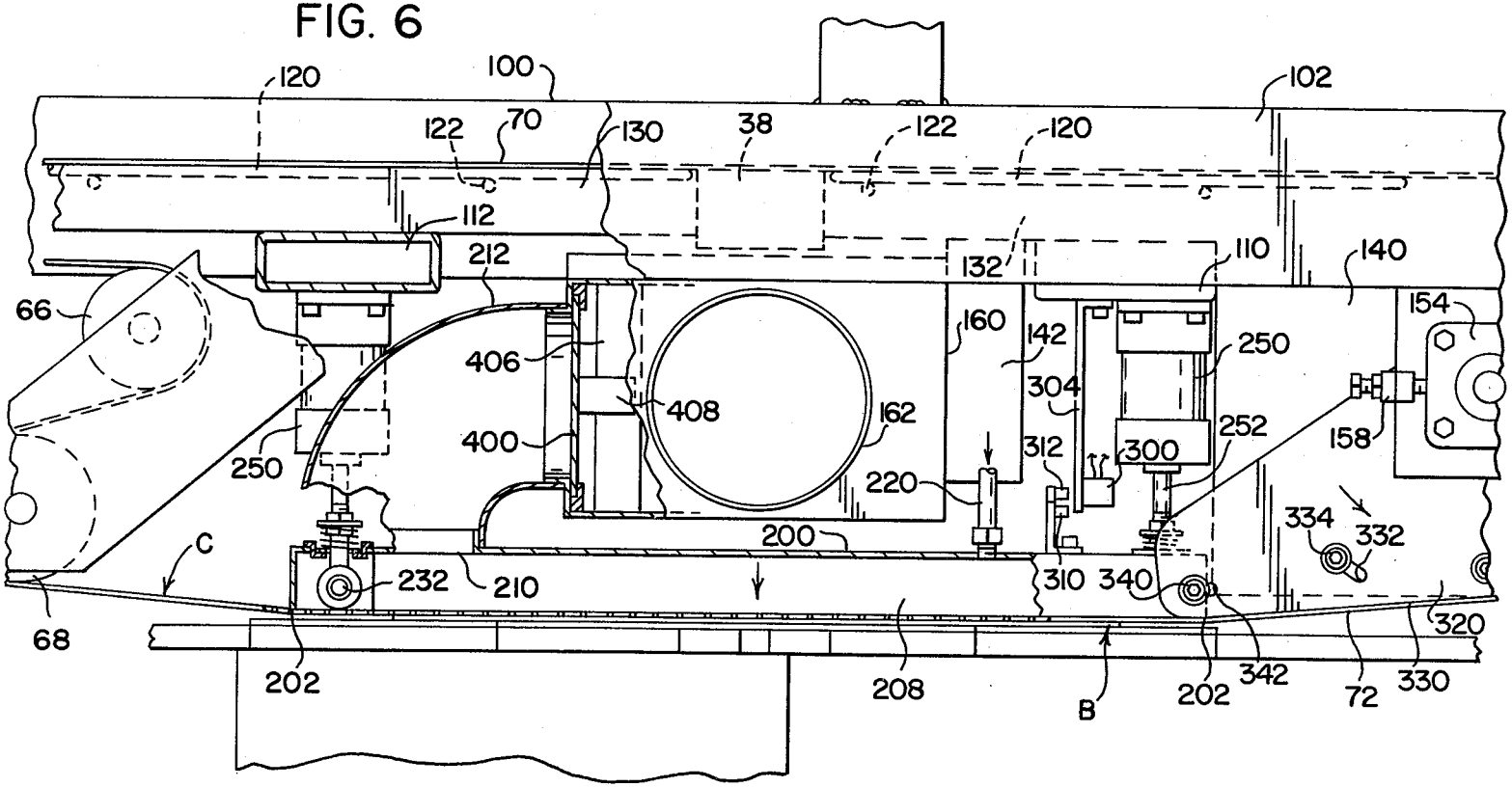
FIG. 6 is a view similar to FIG. 5 cross-sectioned in a different manner to illustrate certain further structural elements of the preferred embodiment.
Figure 9:
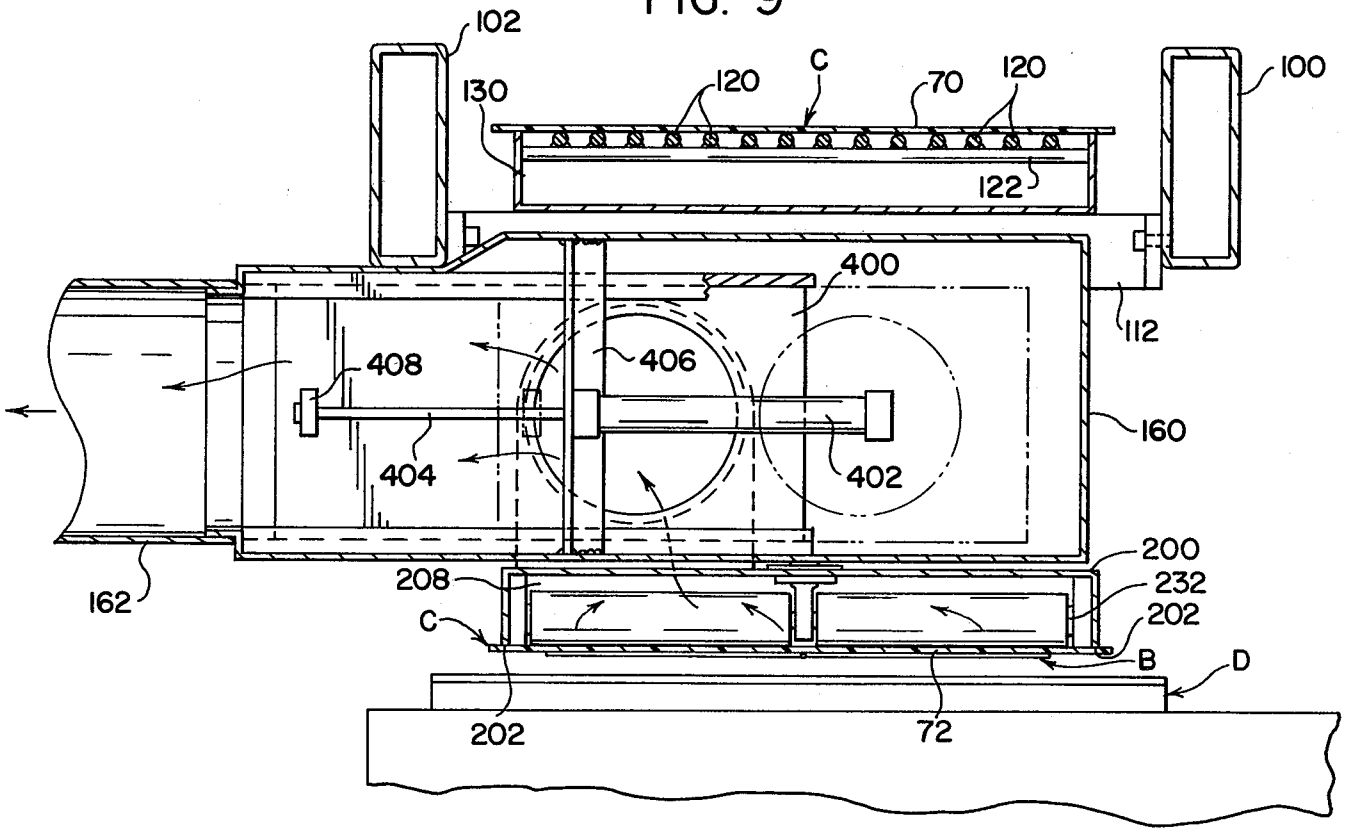
FIG. 9 is an enlarged, partial cross-sectional view taken generally along line 9—9 of FIG. 5; and, FIG. 10 is a schematic wiring diagram for controlling an operating characteristic which can be employed in using the present invention.

There is provided a vacuum system for maintaining a vacuum on the underside of belt C from point X to point Y in FIG. 3. This vacuum system and the support mechanism for the upper run 70 of belt C includes two generally parallel beams 100, 102 terminating in end stands 104, 106. Cross bars or beams 110, 112 are fixed to beams 100, 102 for supporting the structures between upper run 70 and lower run 72. To support belt C there are a plurality of longitudinally extending slide rods 120 secured together by transversely extending tie rods 122 supported within two upper, fixed vacuum boxes 130, 132, as illustrated in FIG. 9. These support structures for the various components are best illustrated in FIGS. 4 and 5 wherein belt C rides along the upper slide rods 120 which have intermediate gaps for accomodation of light source 38. A chamber 140 forms an extension of vacuum box 132 and surrounds the semi-cylindrical inward portion of roll 60. In this manner, vacuum in box 132 is directed to the perforated vacuum roll 60. An inlet chamber 142 extends downwardly from box 132 to provide an inlet for connection of boxes 130, 132 with a vacuum source, which will be described later. To direct the vacuum to the outer surface of roll 60 and, thus, to belt C, roll 60 includes a plurality of apertures 150 terminating in circumferentially extending grooves 152. Thus, the vacuum within chamber 140 is directed through roll 60 to its outer surface. Chamber 140 has a lower open portion which is also communicated with belt C to continue the vacuum supplied to belt C into lower run 72. As can be seen, roll 60 includes spaced shaft bearings 154, 156 which employ an adjustable screw 158, as best illustrated in FIG. 6. This screw is used to shift roll 60 in a horizontal direction with respect to roll 66 for the purpose of controlling the normal path of movement of belt C as it moves around the various rolls. A master vacuum supply box 160 has a large diameter inlet 162 which directs a vacuum from an appropriate source into box 160 for communication with inlet chamber 142. In this manner, vacuum is applied across the top run 70 of belt C, around roll 60 and at the initial part of lower run 72. This vacuum is maintained throughout the operation of the present invention so that a leaf on the outer surface of the belt is held onto the belt until it reaches the lowermost, preselected transfer position above cutting table D. Consequently, a scanned natural tobacco leaf B is carried by belt C in its normal path to a position as shown in FIG. 4. In this position, the scanned leaf is ready for transfer by the apparatus T constructed in accordance with the present invention. This transfer apparatus includes a movable plenum box 200 having a downwardly extending peripheral edge 202 defining a downwardly facing large pressure opening 206 so that pressure within chamber 208 of plenum box 200 is directed through belt C for the purpose of holding a leaf on the belt when a vacuum is in the box and for releasing the leaf when atmospheric pressure or positive pressure is in the box. Box 200 includes a forwardmost or front wall 204 which is adjacent chamber 140 so that a continuous vacuum is supplied between points X, Y when a vacuum is created within chamber 208. To direct vacuum to the box, this box includes a large diameter inlet opening 210 which diameter exceeds at least about six inches. A flexible hose or tube 212 extends from opening 210 to the master vacuum box 160. To direct positive pressure, atmospheric or otherwise, into chamber 208 there is provided an appropriate arrangement including a pipe 220, best shown in FIGS. 6 and 7. A valve controls this pipe to either allow venting to atmosphere or another positive pressure source. As so far described, box 200 forms a continuation of the vacuum system applied to belt C when vacuum is created within chamber 208 and a discontinuation of the vacuum in the transfer position when chamber 208 is provided with a positive pressure.

To transfer a leaf from belt C to cutting table D, located below the belt at the transfer position shown in FIGS. 5 and 6, box 200 is mounted to reciprocate between an upper normal position and a lower transfer position. In both positions, peripheral edge 202 engages the innermost surface of belt C to provide a seal between the belt and inner chamber 208. To mount and reciprocate plenum box 200 there is provided a structure, best illustrated in FIGS. 5–7, which structure includes two parallel, transversely extending rods 230, 232. Since both of these rods operate substantially the same, only rod 230 will be explained in detail and this discussion will apply equally to rod 232. Referring now more particularly to FIG. 7, transversely extending rod 230 includes a center joint 240 allowing transverse pivoting of the shaft to conform with the contour of belt C. For the purpose of reciprocating rod 230 there is provided a drive rod 232 having a fixed collar 244 which may be adjusted by spaced bolts 246, 248. A cylinder 250 having an operating rod 252 moves drive rod 242 downwardly when air is applied to cylinder 250. Thus, air applied to cylinder 250 shifts rod 230 downwardly. This rod includes axially spaced, terminal guide rolls 270, 272 which ride in vertically extending slots 280 in transversely spaced guide blocks 282. Thus, shaft or rod 230 is guided in its vertical movement up and down. Between blocks 200 and rod 242 carrying shaft 230 there is provided a biasing action. In the illustrated embodiment, an abutment cap 260 receives lower end of spring 262. The upper end of the spring abuts collar 244 so that box 200 is biased downwardly with respect to rod 252 of cylinder 250. In this manner, peripheral edge 202 is maintained in spring pressure contact with the inner surface 76 of belt C. Around rod or shaft 230 there are provided axially spaced belt engaging, rotatable sleeves 290, 292 so that pressure by cylinder 250 is exerted against belt C by the action of the rotatably mounted sleeves or abutting elements 290, 292. By using spring 262 only a relative slight pressure is exerted between the edge of box 200 and belt C.

As shown in FIG. 7, sensor switches 300, 302 are mounted on downwardly extending straps 304, 306, respectively. Actuating magnets 310, 312 secured onto the upper portion of box 200 coact with switches 300, 302, respectively for determining when box 200 is in the up or normal position or the down or transfer position. In FIG. 5, box 200 is in the up position with magnet 310 adjacent switch 300. This is the normal position. In the transfer position, as shown in FIG. 6, magnet 312 is opposite switch 302. The respective magnets actuate the respective switches in these two vertically spaced positions.

To maintain the vacuum on belt C at the inlet end of lower run 72 when box 200 is shifted into the transfer position as shown in FIG. 6, there are provided two transversely spaced bridge plates 320, 322 both of which are pivoted around axis of roll 60 and are retained in engagement with belt C as it is moved downwardly with box 200. Since both plates are substantially the same, only plate 320 will be described, and this explanation will apply equally to plate 322. The plate includes a lower facing edge 330 which rides along the inner surface 76 of belt C. Circumferentially extending, arcuate slots 332 are concentric with the axis of roll 60. These slots in plate 320 receive guide pins 334 which control the pivotal movement of plate 320 with respect to roll 60. Bolts 334 are provided on chamber 140, as best shown in FIG. 6. A follower pin 340 connected to the outboard side of box 200 to engage a longitudinally extending slot 342. This pin and slot arrangement, as best shown in FIG. 6, provides the driving force for pivoting plate 320 as box 200 is moved by cylinders 250 between the upper normal position and the lower transfer position.

Figure 8:
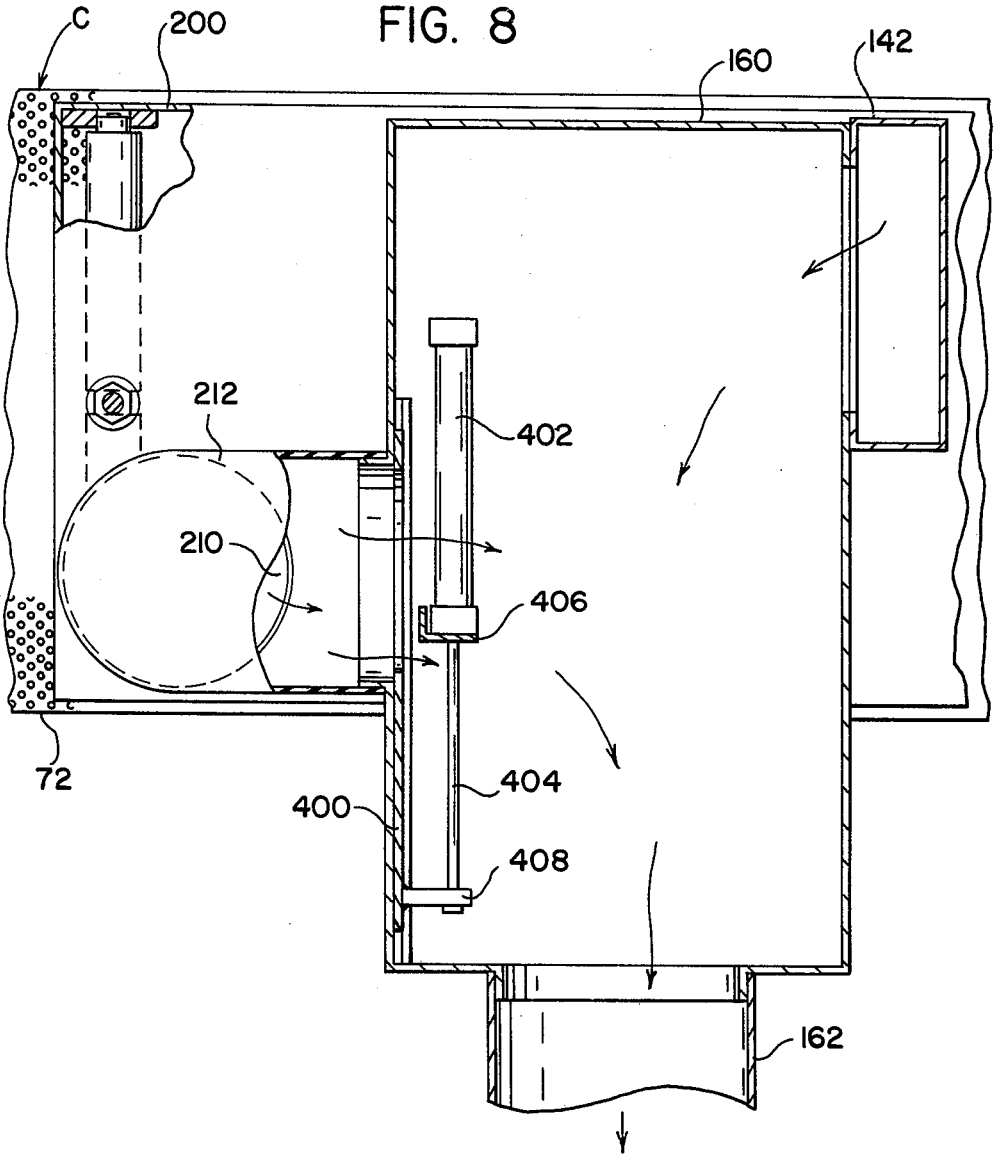
FIG. 8 is an enlarged, partial cross-sectioned view taken generally along line 8—8 of FIG. 5.

As so far explained, a leaf is carried on belt C into the position shown in FIG. 5 by indexing the belt through roll 60. Vacuum within box 200 holds the leaf onto the belt. After the belt has stopped, box 200 is moved downwardly, as shown in FIG. 6, by longitudinally spaced cylinders 250. At that time, the air is vented to chamber 208 through pipe 220. Vacuum applied to cutting table D positioned below the belt, thus, attracts the leaf in an oriented position on the cutting board for subsequent processing as previously discussed. Box 200 is retained in contact with the upper surface of the belt while the primary pressure exerting the belt and leaf carried thereon against a transfer member in the form of a cutting table is exerted by the sleeves on shafts 230, 232. After the transfer operation, box 200 is moved upwardly and a vacuum is again established within chamber 208 for holding the next leaf onto the under side of the belt as it progresses toward the preselected transfer position. In the preferred embodiment, the vacuum to chamber 208 is also discontinued during the transfer operation. To accomplish this, various arrangements could be used. In the illustrated embodiment, as best shown in FIGS. 8 and 9, a slide valve 400 is movable by cylinder 402 having a rod 404 and supported on bracket 406. An arm 408 connected to the slide valve allows actuation of the slide valve by cylinder 402.

Various arrangements could be used for activating and deactivating the vacuum source and positive pressure source to chamber 208 in synchronization with actuation of cylinders 250. FIG. 10 illustrates schematically one arrangement for accomplishing this purpose; however, it is appreciated that this function could be accomplished by either a computer or programmable controller. Relay logic is illustrated in FIG. 10. In accordance with the illustration in FIG. 10, a switch 410 is closed when a transfer is to take place. This is a signal from a programmable controller, computer or otherwise. This signal closes switch 410 to activate relay coil 412. This closes valve 414 which supplies air to cylinders 250. Thus, a signal for closing switch 410 causes the cylinders 250 to move the abutting elements in box 200 downwardly by the structure so far explained. This also closes holding switch 416 so that switch 410 need not be retained. Thus, a momentary signal will cause a transfer action. A switch 420 is closed by switch 302 when belt C is pressed against the transfer table with the leaf to be transferred sandwiched between. This energizes relay coil 422 to open valve 424 which actuates cylinder 402 and closes slide valve 400. At the same time, relay coil 430 is energized to actuate valve 432 for opening vent pipe 220. This applies positive pressure to chamber 208 for effecting a positive transfer of the leaf to the cutting table for subsequent processing. When pipe 220 is opened, switch 434 in FIG. 10 is also open. This deactivates valve 414 which causes cylinders 250 to move upwardly into the normal position. Thus, only one signal needs to be directed to the transfer apparatus T for causing the transfer operation. This closes switch 410. Thereafter, the transfer sequence is as shown in FIG. 10 and awaits the next transfer command, either for a computer or programmable controller or other control device. Of course, other control arrangements could be utilized for practicing the invention as disclosed herein.

Having thus described the invention, the following is claimed:

1. An apparatus for transferring a natural tobacco leaf from a continuous, flexible conveyor belt to a generally flat leaf receiving member at a preselected position in the normal path of travel of said belt, said belt having a known width, a first surface facing away from said receiving member at said preselected position, a second surface facing toward and generally parallel to said receiving member at said preselected position and a plurality of apertures forming pressure equalizing passages between said first and second surfaces, said apparatus comprising: a plenum box having a pressure opening defined by a peripheral edge of said box, said edge lying in a plane parallel to said first surface at said preselected position; means for maintaining a seal between said edge and said belt; means for creating a vacuum in said box and communicated with said opening; means for forcing said belt and box edge at said preselected position from said normal belt path in a direction toward said receiving member and into a transfer position with a leaf on said second surface lying against said receiving member, and means for creating a positive pressure in said box at said preselected position only when said second surface and a leaf thereon are forced against said receiving member.

2. An apparatus as defined in claim 1 wherein said positive pressure creating means includes means for venting said box as said edge is maintained in contact with said first surface.

3. An apparatus as defined in claim 2 including means for sensing when said belt at said preselected position is in said transfer position and means responsive to actuation of said sensing means for actuating said venting means.

4. An apparatus as defined in claim 3 including means responsive to actuation of said venting means for shifting said edge and belt in a direction away from said transfer position and into a normal belt position and means responsive to said belt shifting into said normal position for creating a vacuum in said box.

5. An apparatus as defined in claim 4 including means responsive to actuation of said sensing means for disconnecting vacuum from said box.

6. An apparatus as defined in claim 3 including means responsive to actuation of said sensing means for disconnecting vacuum from said box.

7. An apparatus as defined in claim 6 wherein said sealing means includes means for holding said edges in contact with said first surface at said preselected position.

8. An apparatus as defined in claim 1 wherein said sealing means includes means for holding said edges in contact with said first surface at said preselected position.

9. An apparatus as defined in claim 8 wherein forcing means includes a pair of transversely extending, elongated belt abutting elements positioned generally parallel to each other on opposite ends of said preselected position and means for forcing said elements against said first surface and toward said receiving member.

10. An apparatus as defined in claim 9 wherein said sealing means includes means for holding said edges in contact with said first surface at said preselected position.

11. An apparatus as defined in claim 1 wherein forcing means includes a pair of transversely extending, elongated belt abutting elements positioned generally parallel to each other on opposite ends of said preselected position and means for forcing said elements against said first surface and toward said receiving member.

12. An apparatus as defined in claim 11 wherein said sealing means includes means for holding said edges in contact with said first surface at said preselected position.

13. An apparatus as defined in claim 12 wherein said edge holding means includes a spring means between said abutting elements and said box for biasing said box from said abutting elements in a direction toward said first surface.

14. An apparatus as defined in claim 13 wherein said abutting elements are elongated rollers.

15. An apparatus as defined in claim 11 wherein said abutting elements are elongated rollers.

16. An apparatus as defined in claim 1 wherein said vacuum creating means includes a vacuum conduit communicating said box with a vacuum source and including valve means for isolating said conduit from said vacuum source when said belt is in said transfer position.

17. An apparatus as defined in claim 1 wherein said selected path includes an upper run and a lower run with said first surface of said belt in said upper run facing said first surface of said belt in said lower run and wherein said preselected position is in said lower run.

* * * * *